US005687442A

United States Patent [19]

McLain

[11] Patent Number: 5,687,442

[45] Date of Patent: Nov. 18, 1997

[54] RANDOM ORBITAL POWER CLEANER

[76] Inventor: Scott S. McLain, 7070 Mallard Crossing, Waterford, Wis. 53185

[21] Appl. No.: 660,647

[22] Filed: Jun. 7, 1996

[51] Int. Cl.[6] ..... A46B 13/06

[52] U.S. Cl. ..... 15/29; 15/22.1; 15/97.1

[58] Field of Search ..... 15/22.1, 24, 29, 15/97.1

[56] References Cited

U.S. PATENT DOCUMENTS

| | | | |
|---|---|---|---|
| 4,461,052 | 7/1984 | Mostul | 15/24 X |
| 4,513,466 | 4/1985 | Keddie et al. | 15/28 |
| 4,586,210 | 5/1986 | Mueller | 15/29 |
| 5,385,532 | 1/1995 | Shyu | 601/160 |

FOREIGN PATENT DOCUMENTS

| | | | |
|---|---|---|---|
| 798048 | 2/1936 | France | 15/29 |
| 1565296 | 4/1959 | France | 15/22.1 |
| 478383 | 6/1927 | Germany | 15/29 |
| 289005 | 7/1935 | Italy | 15/97.1 |
| 5-23218 | 2/1993 | Japan | 15/29 |
| 616075 | 3/1980 | Switzerland | 15/22.1 |

*Primary Examiner*—Mark Spisich

*Attorney, Agent, or Firm*—Andrus, Sceales, Starke & Sawall

[57] ABSTRACT

This invention is a new water-powered random orbital power cleaner in which the orbital head rotates in a completely random orbit on which it spins. In addition, this invention involves a foam or bristled shroud which fits around the plastic shell of this invention in order to buff and protect the item being washed, buffed, polished or cleaned with the orbital head.

10 Claims, 2 Drawing Sheets

RANDOM ORBITAL POWER CLEANER

BACKGROUND OF THE INVENTION

This invention relates to a sponge or cleaning device that is driven randomly in a rotational manner by a water turbine and can be held in the hand of the user for washing and polishing automobiles and other items.

The invention also involves a removable shroud which surrounds the plastic housing of the cleaning device. The shroud provides additional cleaning surface and protects the surface of item being cleaned or polished.

SUMMARY OF THE INVENTION

This invention is a new water-powered random orbital power cleaner in which the orbital head moves or travels completely around in an orbital or elliptical path. The head may comprise a synthetic wool, wool, cotton, acrylic or a bristled cleaning device. In addition, this invention incorporates a foam, synthetic wool, wool, cotton, acrylic bristled shroud which fits around the plastic shell of this invention in order to buff and protect the item being polished with the orbital head. Ideally, the shroud is removable, although not necessary, and can be water absorbent.

The advantage to this invention is that the cleaning device or sponge is driven randomly, mimicking human hand movements thereby eliminating circular streaks or swirls which occur on the paint finish when a buffing or cleaning device consistently moves in the same direction and in the same manner, as is the case with conventional, unidirectional cleaning or polishing devices.

Other advantages are that the shroud doubles as a protective bumper and can absorb soap and water thereby cleaning more surface area of the automobile. Not only can the shroud absorb soap and water thereby cleaning more surface area, it: (1) acts as a soft barrier preventing the unit cover or housing from coming into direct contact with the surface being cleaned, therefore minimizing surface damage infliction with the surface being cleaned or polished; (2) should loose or foreign particles be on the surface, the protective bumper acts as a squeegee, keeping the random pad cavity free from such dirt or foreign particles as the unit is pushed across the surface; and (3) contains soap/water solution within the random orbital pad cavity creating a hydroplane action which reduces surface friction and subsequently relates to less surface abrasion and provides a constant push of water/soap solution flushing out from the inner random orbital cavity any dirt or foreign particles just taken off of the surface by a cleaning device.

If the bumper is made of bristles, then the surface area to be cleaned is intensified when scraping the mud or salt. In addition, a random orbital movement increases the perception of shine and luster of finishes by eliminating unidirectional swirl marks. Since shine is a direct result of light reflection, less unit-directional swirls in the finish yield less light refraction and, therefore, less distortion. Less swifts available for light to refract off of create less distortion, therefore, creating a "purer" reflection or image.

This invention is an improvement upon the water power cleaning device outlined in U.S. Pat. No. 4,513,466 ('466) by David P. Keddie. The '466 patent does not have a freely and completely random orbital head in the form of a cleaning device or a sponge. The '466 invention has rotating bristles positively driven in a fixed circular pattern. The '466 patent also does not include a protective or buffing or cleaning shroud about its hard plastic casing.

U.S. Pat. No. 5,385,537 shows a water-powered rotating cleaning device with multiple powered, positively driven orbital cleaning device heads. However, because the heads cannot operate in a random orbital manner, the tendency of the orbital pads to create circular streaks remains.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
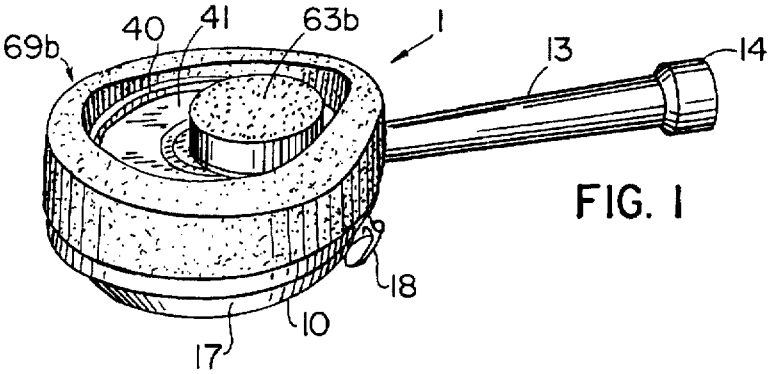
FIG. 1 is a perspective view of the novel random orbital water-powered cleaning device in an upright position.

FIG. 1 is an exterior view of the random water-powered random orbital cleaner or cleaning device 1. It comprises a shell-like top housing, generally indicated by the reference number 10. The housing has a bottom opening which is closed by a cover designated generally by the number 11. The cover is coupled to top housing 10 with snap-acting latch means as will be described in detail later. A conduit 13 is molded integrally with the housing for delivering pressurized water to the turbine rotor from which power for driving the cleaning device rotationally is derived. Conduit 13 also serves as a handle for manipulating the cleaning device while washing an automobile or other item. The handle has an enlarged diameter portion 14 which is internally threaded for receiving the male thread of a hose coupling.

Figure 5:
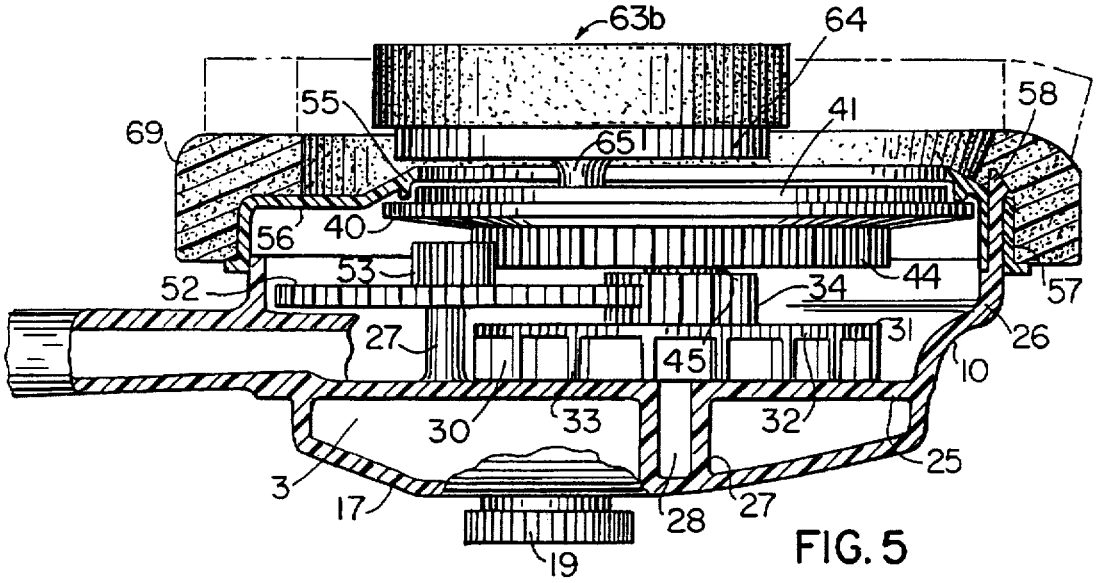
FIG. 5 is a cross-sectional view taken along lines 5—5 of FIG. 4.

The cleaning device in FIGS. 1 and 5 also has an outermost wall 17 which defines a chamber 3 for storing a cleaning fluid that may be metered into the water stream with a valve whose control handle is labeled 18. The cleaning fluid may also include a liquid wax to facilitate combined washing and waxing of an automobile in a single operation. A screw-on cap 19 is provided for admitting a quantity of cleaning fluid into the chamber.

Figure 2:
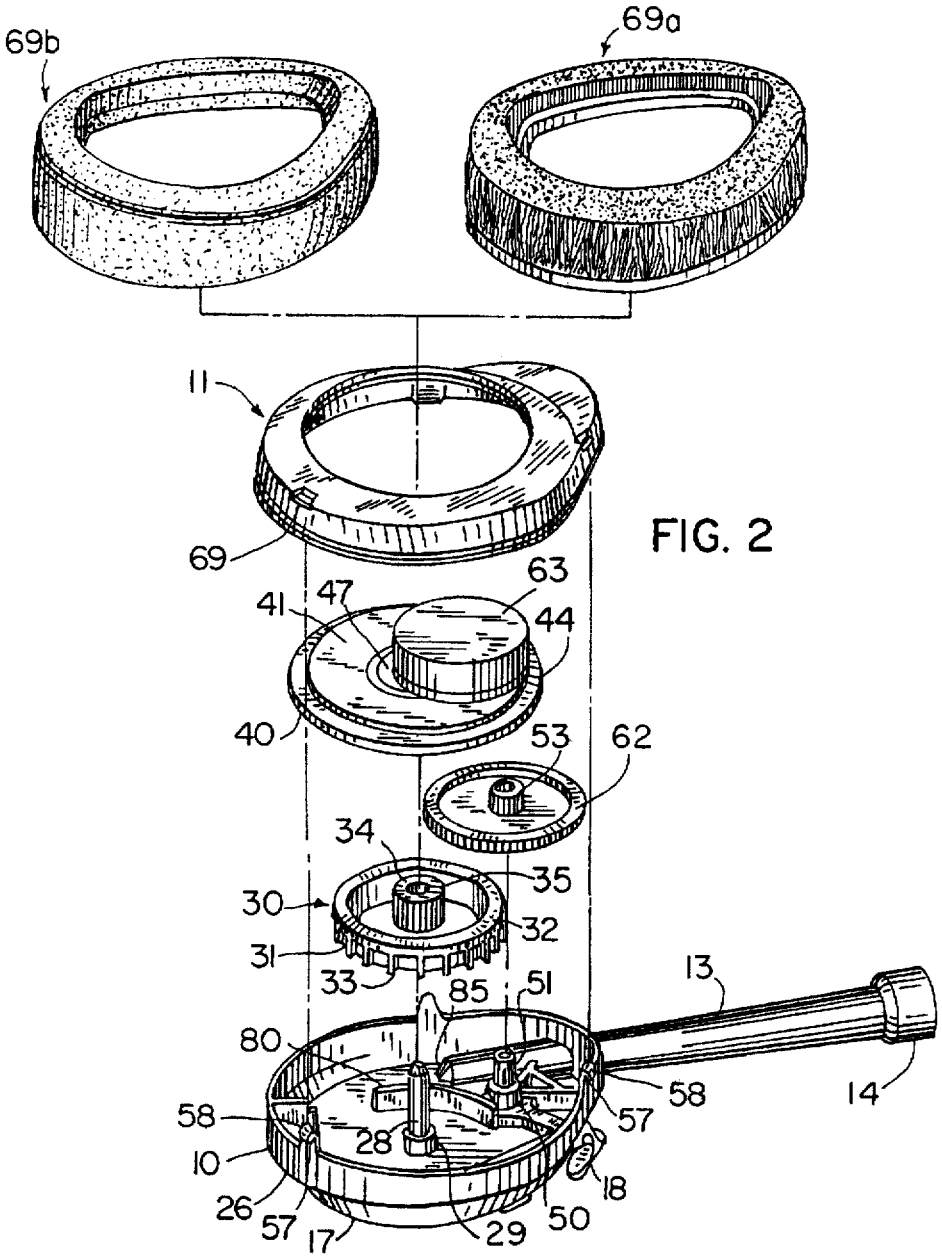
FIG. 2 is an exploded view of this invention.

Referring now to FIGS. 2 and 5, the top housing 10 of the water-powered cleaning device 1 is molded plastic in a single piece with handle 13 and housing 10 comprises a nominally top wall 25 and an integral perimeter wall 26. The top wall 25 and perimeter wall 26 define a housing whose bottom is open until the last step in the cleaning device assembly procedures taken, which is to latch on cover 11 to housing 10. Top wall 25 has a cylindrical projection 27 molded integrally with it. There is a first axial extending shaft 28, preferably metal, fixed as an insert in projection 27 during the housing molding process. On the inside face of top wall 25 a boss 29 is molded.

The turbine rotor is generally designated by the numeral 30. It is basically a disk 31 with a radially extending rim 32 about which there are a plurality of circumferentially spaced part turbine blades 33. A pinion 34 is molded integrally and concentrically to turbine rotor disk 31. The bore 35 of pinion 34 has a diameter substantially greater than the outside diameter of cylindrical boss 29 so that pinion 34 on the rotor fits loosely or with a substantial amount of clearance around boss 29. In other words, as will be shown, the rotor is not journaled for rotation on boss 29, but is otherwise journaled for rotation.

Figure 3:
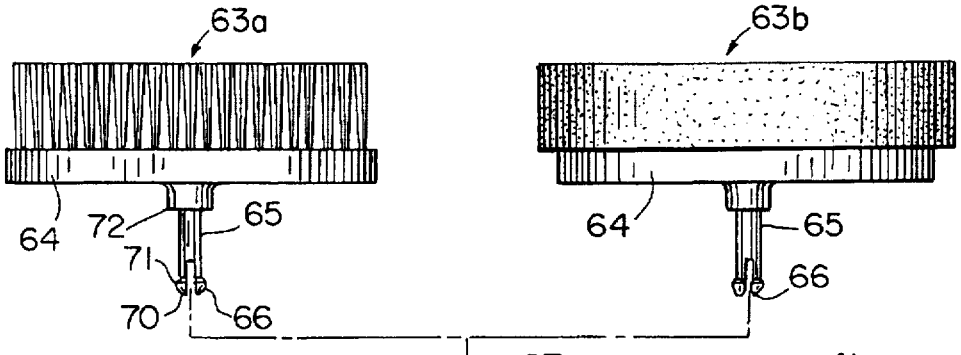
FIG. 3 is a partially cross-sectional view of the random orbital head.
Figure 4:
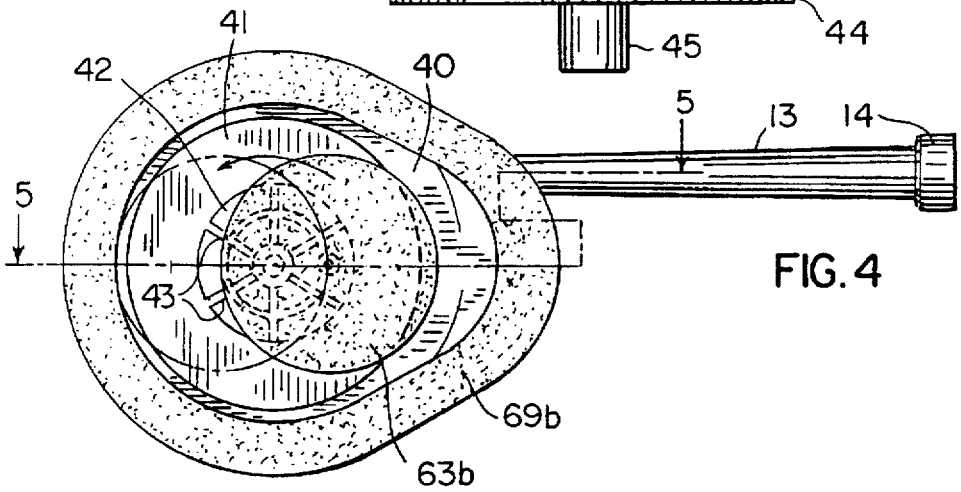
FIG. 4 is a bottom view of the invention.

The rotatable cleaning device assembly comprises a base member in the form of a flat ring or base member disk 40 on which there is an integrally molded circular axial extending guide rim 41 as shown in FIGS. 2, 3 and 4. As can be seen in FIGS. 2 and 4, base member disk 40 has a central hole 42 and radially extending spokes 43. The spokes 43 extend radially far enough to join with the inside diameter of gear 44. A cylindrical shaft 45 extends axially from the center of the spokes. Cylindrical shaft 45 has a bore which permits it to be slipped on and journaled on first stationary metal shaft 28. The end of cylindrical shaft 45 bears on the top surface of boss 29 to limit the distance at the cleaning device assembly and its gear 44 can move inwardly of the housing. The outside diameter of cylindrical shaft 45 is complementary to the inside diameter of pinion 34 which is integral with rotor 30. Thus, rotor 30 is journaled for rotation on cylindrical shaft 45 which is part of the cleaning device assembly.

To summarize, gear 44 and the cleaning device assembly to which it is attached is journaled for rotation on fixed metal shaft 28 and is concentric with rotor 30. Rotor 30, on the other hand is journaled for rotation, by way of bore 35 in pinion 34 on the cleaning device, or in reality, the cylindrical shaft 45 which extends from the cleaning device base member disk 40.

The description thus far explains how the cleaning device and rotor are mounted for rotation about an axis, the manner in which driving force is transmitted from turbine rotor 30 to gear 44 on the cleaning device assembly will now be described. There is a second boss 50 extending axially from and molded integrally with inside top wall 25 of the housing. The boss has a reduced diameter extension 51 molded onto it. Extension 51 constitutes a second shaft whose axis is parallel to the first shaft 28. When the second shaft 51 joins the larger diameter boss 50, a shoulder is created. A gear 52 and pinion 53 are molded integrally and have a common bore for fitting onto second shaft 51 to thereby journal the gear and pinion for joint rotation. Gear 52 meshes with smaller diameter pinion 34 on the turbine rotor 30 and thus there is a speed reduction in the larger diameter gear 52. Pinion 53 meshes with gear 44 on the cleaning device assembly. The gear ratio is such that the cleaning device turns at much slower speed than the turbine rotor 30.

The cleaning device, gear train and rotor assembly are secured in housing 10 with only one part, namely a retainer member or cover 11 which is shown in FIG. 5. As can be seen in FIGS. 5 and 2, the retainer member has an annular rib 55 which is in interfering relation with base member of rim 40 to thereby constrain the cleaning device to remain on a fixed first shaft 28. Substantial end play is allowed throughout the gear train so that no substantial friction is generated with the cleaning device disposed in any attitude, especially since there is water between the moving parts when the cleaning device is in use. As indicated earlier, because the cleaning device and its main gear 44 is blocked against slipping axially off of stationary first shaft 28, all the other moving parts are blocked from separating from the shafts.

The cover or retainer member 11 is essentially a shell that has an axially extending rim 56 which allows the member to be slipped over the perimeter wall 26. A plurality of prongs 57 extend from the edge of perimeter wall 26 of the housing. Since the housing and retainer cover are molded from ABS resin, by way of example and not limitation, the last prongs 57 are resilient and bendable and somewhat like flat springs. The prongs terminate in hook ends 58. When the retainer cover 11 is pressed manually onto wall 26 of the housing, the hook ends slide along the inside wall 26 and are flexed inwardly until the hook ends 58 reach correspondingly shaped holes 59 in rim 56 of the cover 11 whereupon the hook ends spring into the holes and secure the cover 11 onto housing 10.

As shown in FIG. 2, the water input conduit 13 is molded integrally with housing 10 and terminates in an orifice 85 through which the water jet is projected for acting on the blades 33 of the turbine rotor to impel it rotationally. The conduit 33 is formed unitarily with housing 10 and with barrier wall 80 which projects from top wall 25 of the housing. Barrier wall 66 has the configuration of a segment of a circle and is concentric with but slightly spaced from the tips of the rotor blades 33 so the rotor can rotate without frictional drag. Moreover, the barrier wall 66 assures that all of the water jets projected from orifice 65 will do useful work on turbine blades 33 without undue turbulence.

Cylindrical shaft 45 supports and is molded integrally with base member disk 40 and extending guide rim 41. A short, cylindrical open-ended sleeve 67 is integral with base member disk 40 and positioned off center from cylindrical shaft 45. Random orbital head 63 includes a circular support plate 64 with a central stub shaft or stem 65 extending perpendicularly downward from the under side of support plate 64. The stem 65 includes a resilient spade connection 66 at its end. The spade connection 66 includes a split end adapted to collapse for insertion into sleeve 67, spade connection 66 having a tapered lead 70 to assist the insertion and also a steep tapered retaining shoulder 71 adjacent to tapered lead 70 to accommodate removal. Tapered lead 70 fits into sleeve 67, and with stem 65 supports the orbital head for rotation. Stem shoulder 72 is located on the bottom side of plate 64 and rests on sleeve 67 when stem 65 is inserted into sleeve 67. Stem shoulder 72 acts as an abutment means to hold the axial position of the random orbital head when in sleeve 67 during use. The axial length of sleeve 67 is about the same as the distance between stem shoulder 72 and tapered lead 70. The central axis of sleeve 67 is radially offset and parallel to base disk member axis.

The random orbital head 63 can be made of bristles as shown in 63(*a*) or flexible plastic foam material as shown in 63(*b*). The bristles or foam may be attached to plate 64 in any convenient manner. The head 63 is freely rotatable inside sleeve 67 allowing the random orbital head to turn in a completely random, arbitrary manner in either direction in response to the driven rotary motion movement of base member disk 40 and operator movement of the power cleaner over the surface.

Shown in FIG. 2, shroud 69(*a*) made of bristles on a resilient backing (such as foam or plastic), or shroud 69(*b*) made only of foam, permanently or demountably fits over cover 11, and preferably glued to it, thereby providing a soft surface in which to buff a car or other surface being cleaned and polished. The material backing for shroud 69(*a*), and the shroud 69(*b*) itself should be of a material which can conform to cover 11 and not lose its shape. The shroud material or cleaning mechanism should be soft enough not to scratch or harm the surface being polished or cleaned. Ideally, the material should be of the type to clean or buff the surface. Preferably, foam pads used in random orbital head 63(*b*) or shroud 69(*b*) are made of a reticulated or non-reticulated open or closed cell polyurethane foam, polyester or any desirable polymeric foam suitable for this purpose.

The cleaning face of the shroud is preferably generally coplanar with the cleaning face of the random orbital pad 63(*b*) or bristled head 63(*a*).

Key to this invention is the random orbital head and its free movement. In addition, the shroud 69 which fits over cover 11 is also key to this invention because it buffs, cleans and protects the surface to which it is applied. The shroud will minimize any chance of damage infliction to any abutment, appendage or molded part protruding said item being cleaned, polished or buffed.

I claim:

1. A water-powered cleaning apparatus comprising:

a base member disk rotatably mounted in a housing wherein said base member disk is driven by a water powered turbine drive mechanism, said base member disk mounted for driven rotation on a central axis;

an orbital head mounted on said base member disk for free and random rotation on an axis that is parallel to and radially offset from said central axis of said base member disk;

said orbital head having a cleaning medium attached thereto.

2. The water-powered cleaning apparatus of claim 1 wherein said base member disk includes an integral sleeve;

said orbital head is mounted to said base member disk by a stem integral with said orbital head which fits into said sleeve allowing free rotation.

3. The water-powered cleaning apparatus of claim 2 wherein said stem includes a resilient spade connection wherein said spade connection is a collapsible split end having a tapered lead for insertion into said sleeve.

4. The water-powered cleaning apparatus of claim 3 wherein said spade connection also includes a steep tapered retaining shoulder located adjacent to said tapered lead to assist in removal of said stem.

5. The water-powered cleaning apparatus of claim 4 wherein said base member disk has an integral shoulder extending from the bottom of said base member disk and integral with said stem, said shoulder acting as an abutment means to hold said axial position of said orbital head.

6. The water-powered cleaning apparatus of claim 1 wherein said cleaning medium is comprised of bristles.

7. The water-powered cleaning apparatus of claim 1 wherein said cleaning medium is comprised of plastic foam.

8. The water-powered cleaning apparatus of claim 1 wherein said housing houses said base member disk and said turbine drive mechanism and wherein a demountable shroud covers said housing.

9. The water-powered cleaning apparatus of claim 8 wherein said shroud is comprised of plastic foam.

10. The water-powered cleaning apparatus of claim 8 wherein said shroud is comprised of bristles.

* * * * *